US008501282B2

(12) United States Patent
Staunton et al.

(10) Patent No.: US 8,501,282 B2
(45) Date of Patent: Aug. 6, 2013

(54) PAINT APPLICATOR

(75) Inventors: Thomas J. Staunton, Euclid, OH (US); Gregory A. Brainard, Spencer, OH (US); Michael J. Brainard, Spencer, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 214 days.

(21) Appl. No.: 12/579,491

(22) Filed: Oct. 15, 2009

(65) Prior Publication Data

US 2010/0098870 A1 Apr. 22, 2010

Related U.S. Application Data

(60) Provisional application No. 61/106,229, filed on Oct. 17, 2008.

(51) Int. Cl.
*B05D 1/02* (2006.01)

(52) U.S. Cl.
USPC ..... 427/426; 118/50; 118/300; 137/206; 137/209; 222/94; 222/105; 222/145.5; 222/145.6; 222/209; 239/323; 239/324; 239/325; 239/327; 239/330

(58) Field of Classification Search
USPC ..... 427/426; 222/94, 105, 145.5, 145.6, 222/209, 213, 214, 324; 239/323, 324, 325, 239/327, 329, 330, 331, 337, 356, 357, 362, 239/363; 137/206, 209
See application file for complete search history.

(56) References Cited

U.S. PATENT DOCUMENTS

| | | | | |
|---|---|---|---|---|
| 4,005,825 | A | 2/1977 | Schowiak | |
| 4,237,881 | A * | 12/1980 | Beigler et al. | 604/141 |
| 5,242,081 | A * | 9/1993 | van der Heyden et al. | 222/1 |
| 5,713,519 | A | 2/1998 | Sandison et al. | |
| 6,953,155 | B2 | 10/2005 | Joseph et al. | |
| 7,000,657 | B1 * | 2/2006 | Thorpe et al. | 141/207 |
| 7,090,072 | B1 | 8/2006 | Elliott | |
| 7,160,475 | B2 * | 1/2007 | Scipioni | 216/2 |
| 7,188,785 | B2 | 3/2007 | Joseph et al. | |
| 7,311,265 | B2 | 12/2007 | Bhatia | |
| 7,353,964 | B2 | 4/2008 | Kosmyna | |
| 2005/0147761 | A1 * | 7/2005 | Parks et al. | 427/421.1 |
| 2007/0181599 | A1 * | 8/2007 | Kosmyna et al. | 222/95 |
| 2007/0191702 | A1 * | 8/2007 | Yodfat et al. | 600/365 |

FOREIGN PATENT DOCUMENTS

| | | | |
|---|---|---|---|
| EP | 1402957 | A2 | 3/2004 |
| GB | 681982 | A | 11/1952 |

OTHER PUBLICATIONS

PCT International Searching Authority, PCT International Search Report and Written Opinion, Oct. 17, 2008.

* cited by examiner

*Primary Examiner* — Timothy Meeks
*Assistant Examiner* — Nathan T Leong
(74) *Attorney, Agent, or Firm* — Eryn Ace Fuhrer; Robert E. McDonald; Deron A. Eook

(57) ABSTRACT

A system for applying coatings and more specifically paint coatings is provided that combines fluid stored in separate reservoir containers prior to expelling the mixture for application. The reservoirs may be comprised of collapsible and disposable bags that eject its fluid upon activation of an actuator or expanding bladder. The fluid components are combined and blended together in a mixer that is positioned between the reservoirs and a nozzle.

12 Claims, 4 Drawing Sheets

PAINT APPLICATOR

CROSS-REFERENCE TO RELATED APPLICATIONS

This application claims priority from Provisional Application No. 61/106,229 filed Oct. 17, 2008, the entirety of which is hereby incorporated by reference.

TECHNICAL FIELD

The present invention pertains to systems for dispensing multi-component coatings, and in particular, paint coatings. The system incorporates multiple reservoirs that combine separate components of the paint coatings into a mixer and subsequently through a nozzle.

BACKGROUND OF THE INVENTION

Coatings are applied to the surfaces of many products for various reasons. Some coatings are used to lubricate moving parts or reduce glare on optical lenses. Other coatings protect against rust and corrosion while still others are applied purely for decoration. Paint is one example of a coating widely in use today. Typically, paint is applied to a substrate and includes components that cure or harden to form a thin layer of film. Advances over the past few decades have produced paint products that significantly extend the life of a painted article by reducing the effects of corrosion due to ambient conditions.

In many instances, paint consists of multiple components that must be combined prior to its application onto the substrate. In many cases, the components are reactive components (e.g. in solutions or dispersions), which are mixed together and react with each other in a crosslinking reaction to provide a curable coating composition. Up until the point of mixing, none of the individual components alone provides a curable coating composition. Typically, upon mixing, such multi-component coatings react and cure quickly. Thus, it is beneficial to mix the components together and apply the paint to a substrate soon after mixing. Paint may also consist of other ingredients, including but not limited to pigments, solvents catalysts, adhesion promoters, and UV light absorbers. Each of these ingredients can be used to impart various desired properties to the paint composition.

It is an important factor in using multi-component coatings that the components of the coating be mixed in precise quantities, i.e. at predefined ratios. As such, the process of mixing paint requires careful attention on the part of the operator. It may also be important to gauge how much paint is needed for a specific application. Mixing the right amount of paint can minimize material waste and cost.

BRIEF SUMMARY

The embodiments of the present invention pertain to a system for applying coatings and more specifically paint coatings. The system includes a spray gun having a nozzle that dispenses the paint in a spray pattern. Pressurized air is directed through the nozzle from a remote source, like for example an air compressor. A reservoir chamber is also included, which houses separate containers each filled with a different component of the paint. The components are fed through a series of orifices that combine the components at a particular mix ratio. Pressure from an inflatable bladder expels the components under pressure, of which the combined components are channeled into a mixing device that blends the components together just prior to being introduced into the nozzle.

In one aspect of the embodiments of the subject invention, the containers are plastic bags that collapse to expel the paint components into the mixer.

In another aspect of the embodiments of the subject invention, the mixing device is a static mixer having baffles that channel the paint components through a circuitous pathway.

Another aspect of the embodiments of the subject invention includes an orifice plate that covers the collapsible bags.

In even another aspect of the embodiments of the subject invention, the orifice plate may include individual apertures that allow the paint components to be combined in a particular mix ratio.

In still another aspect of the embodiments of the subject invention, the orifice plate is disposable. Additionally, the mixing device may also be disposable.

In even yet another aspect of the embodiments of the subject invention, the orifice plate may be exchanged with another orifice plate that mixes the paint components at a different mix ratio.

In another aspect of the embodiments of the subject invention, air drawn from an air compressor feeds the spray gun to dispense the paint and actuates the bladder to expel the components from the collapsible bags in the mixing device.

DETAILED DESCRIPTION OF THE INVENTION

Figure 1:
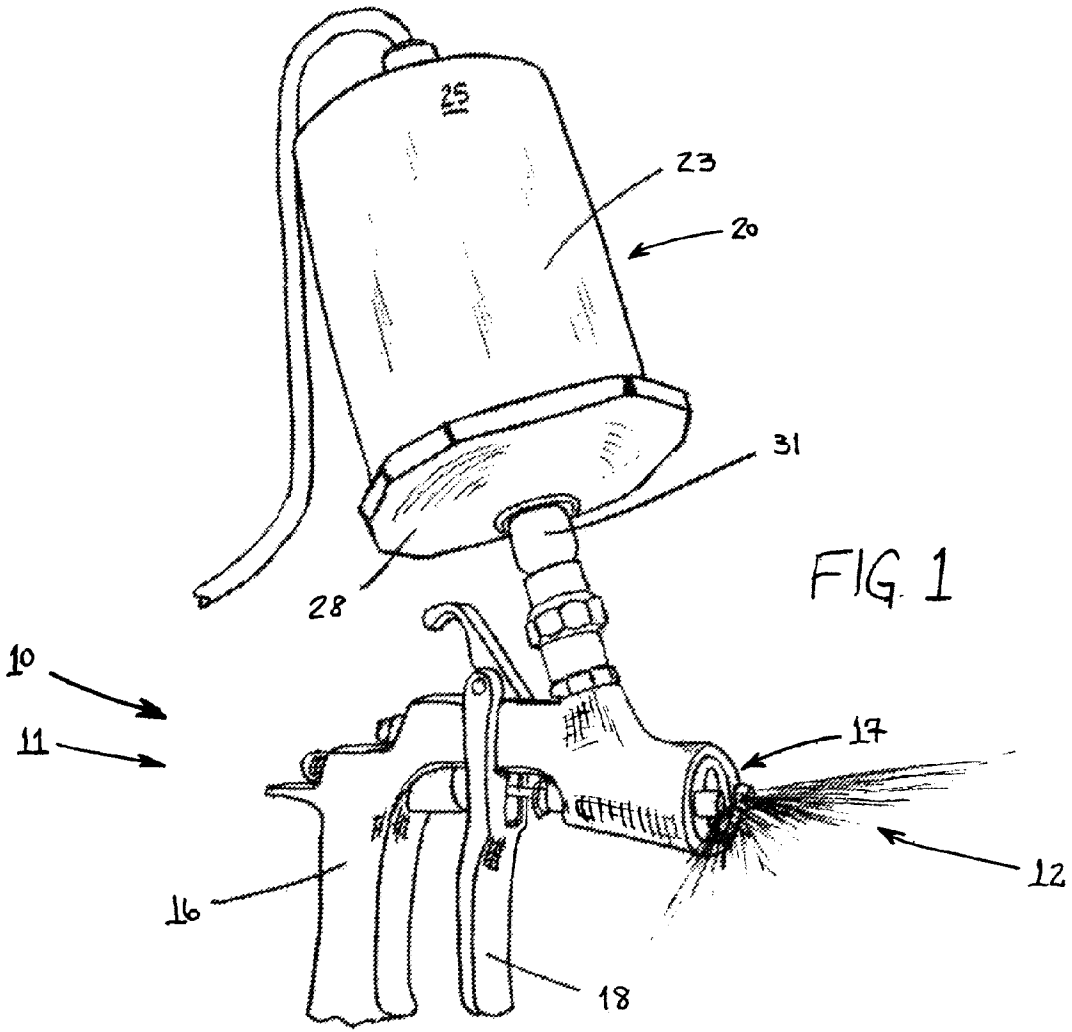
FIG. 1 is a perspective view of an applicator for dispensing a coating according to the embodiments of the subject invention.

Referring now to the drawings wherein the showings are for purposes of illustrating embodiments of the invention only and not for purposes of limiting the same, FIG. 1 shows an applicator 10 for applying a generally fluid substance, which may be a coating 12 for finishing the surface of a substrate. In one embodiment, the coating 12 consists of multiple reactive components that combine to form the finished product. For illustrative purposes, the embodiments of the subject invention will be described in the context of applying a specific type of coating 12, namely paint formed from multiple reactive components 12. However, it is to be construed that any multi-component fluid substance may be used with applicator 10 without departing from the intended scope of coverage of the embodiments of the subject invention.

With reference to FIG. 1, the applicator 10 may comprise a spray gun 11 using pressurized medium to propel the paint 12. The spray gun 11 includes a frame 15 that supports a handle 16 for manipulating the spray gun 11 and a nozzle 17 for dispensing the paint 12 in a particular spray pattern. The nozzle 17 may be connected to one or more paint component reservoirs 20 designed to hold the various components mentioned above. To dispense the paint 12, pressurized medium may be channeled from a remote source through a hose or other conduit into the spray gun 11. In the preferred embodiment, pressurized air is used to propel the paint 12 as supplied from, for example, an air compressor, not shown in the Figures. However, any form of pressurized medium may be chosen as is appropriate for use with the embodiments of the present invention. The applicator 10 may further include a switch 18, which in one embodiment, may be a trigger 18, for activating the spray gun 11. The trigger 18 engages to dispense the paint 12 by controlling the flow of pressurized air channeled through the spray gun 11. In this manner, activating the trigger 18 releases the flow the pressurized air that atomizes the paint components and propels the paint 12 from the nozzle 17. Persons of ordinary skill in the art will appreciate the use of flow control valves, pressure regulators and other similar equipment with compressed air systems.

Figure 2:
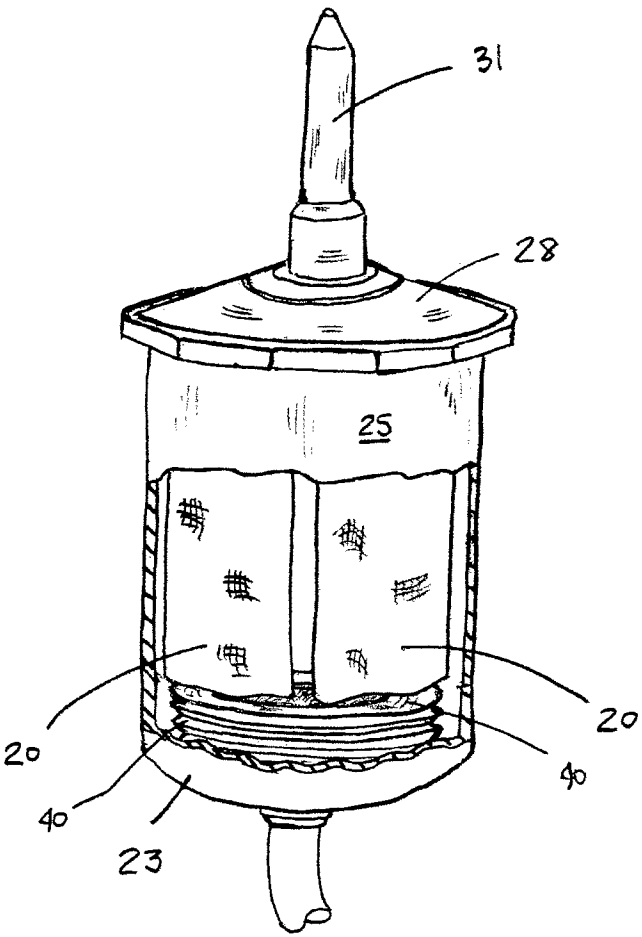
FIG. 2 is partial cutaway, perspective view of a reservoir chamber according to the embodiments of the subject invention.

With reference to FIG. 2, a reservoir chamber 23 is provided that supports one or more reservoirs 20, which contain the various paint components. The reservoir chamber 23 is constructed from one or more walls 25 that comprise a support structure or housing. The walls 25 may be generally rigid and may define an interior region designed to contain the reservoirs 20. In one embodiment, the reservoir chamber 23 also houses an actuator 40 constructed to expel or dispense the paint components from their respective reservoirs 20. A cap 28 is also incorporated having a first function to enclose the interior region of the reservoir chamber 23. Additionally, the cap 28 may function to support a conduit 31 and static mixer 50 that blends the components together prior to introducing the mixture into the pressurized stream of air, as will be discussed further in a subsequent paragraph.

Figure 3:
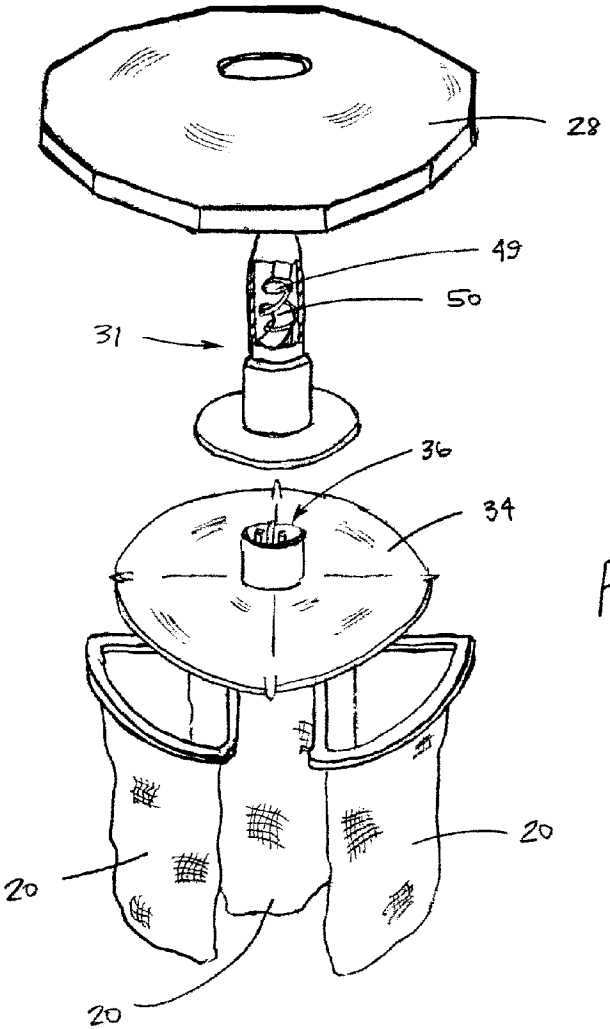
FIG. 3 is an exploded view of the reservoir chamber of FIG. 2 showing collapsible reservoirs according to the embodiments of the subject invention.

Referencing FIGS. 2 through 3, the components of paint 12 may be stored in individual reservoirs 20. One reservoir 20 may be provided for each separate component of the paint mixture. In an exemplary manner, three reservoirs 20 are provided and may respectively contain film forming binder, crosslinking agent and catalyst. Alternatively, the reservoirs 20 may each contain, for example, separate pigmented toners that combine in specific proportions to produce a desired color. However, it is to be understood that any number of reservoirs 20 may contain any combination of substances as is suitable for use in making the paint 12 or coating 12. It will be appreciated that certain products combine individual components in specific ratios and while the reservoirs 20 depicted in the Figures may appear similar in size, same or differently sized volume reservoirs 20 may be utilized as required by a specific mix ratio. In fact, any quantity and/or volume of reservoirs 20 may be incorporated as is appropriate for use with the embodiments of the present invention. In another embodiment, a single reservoir with multiple sections may be used. Each section may be individually referred to herein as a reservoir.

With continued reference to FIG. 3, the reservoirs 20 may be fluidly communicated to a mixing device 49. The mixing device 49 may function to mix the components of the paint 12 together. In particular, the mixing device 49 may sufficiently blend the components to produce a substantially homogeneous mixture. The mixing device 49 may be comprised of a static mixer 50 received within conduit 31. In one embodiment, the static mixer 50 may incorporate a series of baffles that define a circuitous pathway for thoroughly mixing the paint components. Still, any means for mixing the paint components together may be incorporated, including but not limited to rotating impellers. In this manner, the components of the paint 12 enter a first end of conduit 31, pass through the static mixer 50, and egress through a distal end of conduit 31 where the mixture is introduced into the pressurized stream of air as described above.

The applicator 10 may further include an orifice plate 34 for metering particular quantities of the paint components into the conduit 31 and mixing device 49. The orifice plate 34 may be generally planar and may cover the reservoirs 20 filled with the respective components of paint 12. In one embodiment, the orifice plate 34 may be concave and may have a monolithic structure. However, any configuration of orifice plate 34 may be chosen as is appropriate for use with the embodiments of the present invention. Additionally, channels 36, which may be holes or apertures 36 fashioned in the orifice plate 34, may be incorporated for directing fluid from the reservoirs 20 into the conduit 31. It is noted here that the orifice plate 34, apart from metering fluids into the mixing device 49, prevents fluid in one reservoir from mixing with fluids from another reservoir. Stating it another way, when assembled, the orifice plate 34 may function to cap the individual reservoirs 20 preventing the intermixing of paint components. Additionally, the orifice plate 34 may incorporate check valves, not shown, that prevent paint 12 once mixed together from flowing back into the reservoirs 20. The check valves may be disposed within or proximate to the apertures 36. However, the check valves may be positioned at any location that prevents the back flow of fluid into the reservoirs 20. In one embodiment, the orifice plate may be equipped with a peripheral extension. Such a peripheral extension may be positioned within the reservoir chamber and/or reservoir(s), or around the outer periphery of the reservoir chamber and/or reservoir(s). The peripheral extension may also be placed within or around the reservoir chamber but not within or around the reservoir(s). In an alternative embodiment, the orifice plate may be positioned on top of, but not within or around, the reservoir chamber and/or reservoir(s).

As just mentioned, the channels 36, or apertures 36, meter fluid from the multiple reservoirs 20 into the conduit 31 and subsequently into mixing device 49. Accordingly, one aperture 36 may be included for each reservoir 20. It will readily seen that the size of apertures 36 will determine the amount of fluid allowed to flow therethrough thus fixing the ratio at which the paint components are combined. In one embodiment, each of the apertures 36 provided may be similar in size. That is to say that each aperture 36 dispenses or directs fluid at substantially the same rate. In another embodiment, the apertures 36 may facilitate flow at different rates as accomplished by providing one aperture 36 having a larger or smaller diameter than another or by providing multiple similarly sized apertures 36 that connect to a single reservoir 20. Still, any manner of metering fluid from the reservoirs 20 into the mixing device 49, in any proportions, may be chosen without departing from the intended scope of coverage of the embodiments of the subject invention. It is noteworthy to mention here that the orifice plate 34, conduit 31 and mixing device 49 may be disposable elements of the applicator 10. This makes it easy for an operator to clean and maintain the spray gun 11 for subsequent use. Additionally, changing the mix ratio of the paint 12 may be easily accomplished simply by exchanging one orifice plate 34 with that of another having a different pattern or size of apertures 36.

Figure 4:
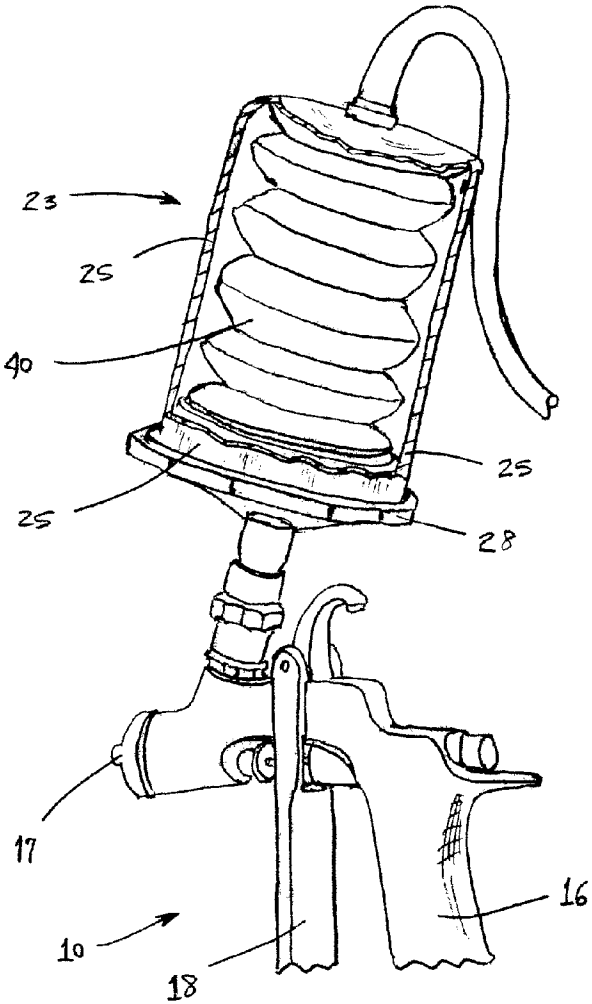
FIG. 4 is a partial cutaway, perspective view of the applicator shown in FIG. 1 according to the embodiments of the subject invention.

Continuing to reference FIG. 3 and now also FIG. 4, the reservoirs 20 may be collapsible, which allows its contents to be dispensed by compressing the reservoirs 20 under force. In one particular embodiment, the reservoirs 20 may be produced as bags 21 constructed from a generally pliable material, such as for example a polymeric material or a foil material. In this manner, the bags 21 may expand up to a maximum volume for holding a fluid substance and may be compressed to expel the fluid during operation of the applicator 10. It follows from that described above, that the bag size, i.e.

volume, may vary from one bag 21 to the next in a manner consistent with metering the paint components at a predetermined ratio. It is expressly noted here that the bags 21 may be disposable making it convenient to set up the applicator 10 for any particular mix ratio as well as making it convenient to clean and maintain the applicator 10.

To expel the fluid, an actuator 40 is provided that engages to apply pressure to the collapsible reservoirs 20. The actuator 40 may be comprised of a bladder 42 that expands when filled with a pressurized medium. In one embodiment, the bladder 42 may be accordion shaped having wall sections that fold one upon another, although other bladder configurations may be implemented as is appropriate for use with the embodiments of the present invention. Moreover, any type of expanding actuator 40, mechanical or otherwise, may be chosen to expel fluid from the reservoirs 20. In this manner, action from engaging the actuator 40 compresses the reservoirs 20 thereby pressurizing the fluid components therein for expulsion through the apertures 36. It will be recognized that the pressure of the paint components entering the conduit 31 may be sufficient to project the fluid through the static mixer 50 thoroughly blending the paint 12 upon contact with the baffles. Thus a substantially homogeneous mixture is provided just prior to introducing the paint 12 into the nozzle 17.

The actuator 40, and in particular the accordion shaped bladder 42, may be actuated by pressurized air supplied from a remote source, which may be an air compressor. The actuator 40 may have a dedicated air line connected directly to the air compressor. However, in one embodiment, air flow for activating the actuator 40 may be diverted from the air stream connected to the spray gun 11. It is to be understood that in either instance, the actuator 40 is activated when the trigger 18 is depressed. It follows that as the trigger 18 is released, the flow of air to the actuator 40, as well as the spray gun 11, stops or is closed off.

With reference now to all of the Figures, operation of the applicator 10 will now be discussed. An operator may respectively fill individual reservoirs 20, i.e. collapsible bags, with components of a paint 12 or coating 12 that is to be dispensed by the applicator 10. The operator may select bags that hold a particular quantity of fluid as determined by the mix ratio of the paint 12 or coating 12. Additionally, the operator may select an orifice plate 34 having a particular number and size of apertures 36 that correspond to the number of bags and to the mix ratio. Subsequently, the bags may be filled and placed into the reservoir chamber 23 for installation into the spray gun 11. Alternatively, pre-filled bags may be provided, which eliminates one step in the setup process. Hoses or other conduit may then be connected that route pressurized medium, which may be pressurized air, to the spray gun 11 and to the actuator 40. Activation of the trigger 18 will then release the flow of pressurized medium through the spray gun 11 discharging fluid from the bags into the mixing device 49 and subsequently into the nozzle 17.

The invention has been described herein with reference to the disclosed embodiments. Obviously, modifications and alterations will occur to others upon a reading and understanding of this specification. It is intended to include all such modifications and alterations insofar as they come within the scope of the appended claims or the equivalence thereof.

What is claimed is:

1. A coating applicator, comprising:

a nozzle configured for dispensing an associated mixture;

a mixing device in fluid communication with the nozzle;

a plurality of fluid storing reservoirs operatively communicated to meter multiple associated fluid components into the mixing device; and, an actuator operatively engaged with the plurality of fluid storing reservoirs, wherein said actuator comprises an expandable bladder that expands to compress the plurality of fluid storing reservoirs thereby expelling the associated fluid components from the plurality of fluid storing reservoirs.

2. The apparatus as defined in claim 1, wherein the mixing device is a static mixer.

3. The apparatus as defined in claim 1, wherein the static mixer includes one or more baffles defining a circuitous route for blending the associated fluid components.

4. The apparatus as defined in claim 1, wherein the plurality of fluid storing reservoirs are comprised of collapsible bags.

5. The apparatus as defined in claim 1, wherein the expandable bladder is accordion shaped.

6. The apparatus as defined in claim 1, wherein the plurality of fluid storing reservoirs comprises at least two fluid storing reservoirs.

7. The apparatus as defined in claim 6, wherein the at least two fluid storing reservoirs contain paint components which are reactive with each other upon mixing.

8. The apparatus as defined in claim 1, further comprising a reservoir chamber.

9. The apparatus as defined in claim 8, wherein the plurality of fluid storing reservoirs and the actuator are housed in the reservoir chamber.

10. The apparatus as defined in claim 8, further comprising an orifice plate.

11. The apparatus as defined in claim 10, wherein the orifice plate comprises channels in fluid communication with the mixing device.

12. The apparatus as defined in claim 11, wherein the orifice plate is positioned on top of the reservoir housing.

* * * * *